US005528784A

United States Patent [19]

Painter

[11] Patent Number: 5,528,784

[45] Date of Patent: Jun. 25, 1996

[54] ADJUSTABLE SUPPORT PILLOW FOR COMFORTABLE REPOSE

[76] Inventor: Carolyn E. Painter, 37 E. 14th St., Tempe, Ariz. 85281

[21] Appl. No.: 367,978

[22] Filed: Jan. 3, 1995

[51] Int. Cl.[6] ..... A47C 23/06

[52] U.S. Cl. ..... 5/640; 5/645; 5/636

[58] Field of Search ..... 5/636–645, 657

[56] References Cited

U.S. PATENT DOCUMENTS

| | | | |
|---|---|---|---|
| 395,043 | 12/1888 | Doremus | 5/645 |
| 2,295,906 | 9/1942 | Lacour | 5/636 |
| 2,409,820 | 10/1946 | Zimmern | 5/645 |
| 3,148,389 | 9/1964 | Lustig | 5/643 |
| 3,400,413 | 9/1968 | Grossa | 5/636 |
| 3,604,026 | 9/1971 | Schelps | 5/640 |
| 3,667,074 | 6/1972 | Emery | 5/636 |
| 4,349,925 | 9/1982 | Macomber | 5/636 |

FOREIGN PATENT DOCUMENTS

| | | | |
|---|---|---|---|
| 11306 | of 1895 | United Kingdom | 5/636 |

*Primary Examiner*—Flemming Saether
*Attorney, Agent, or Firm*—Richard R. Mybeck; Peter B. Scull

[57] ABSTRACT

An adjustable pillow that supports the head and neck of a user when laying on his/her side or in face downward position is described. This pillow has a central base portion and one or more lateral protrusions, particularly including upper lateral protrusions, all of which are integrally connected to said central base portion. Means are provided for securing one or more lift pads beneath the pillow to vary the height of the pillow surface relative to the plane upon which the pillow and its user are supported.

12 Claims, 1 Drawing Sheet

ADJUSTABLE SUPPORT PILLOW FOR COMFORTABLE REPOSE

INTRODUCTION

The present invention relates generally to an adjustable support pillow and more particularly to a pillow having a contoured configuration for selectively supporting and cantilevering portions of the human head to enhance rest and eliminate deteriorous side effects of unwanted pressure on the cheek, jaw, chin and mouth during repose.

BACKGROUND OF THE INVENTION

Most human beings need to sleep. Whether we sleep long hours or just a few, we need our rest. Some persons sleep on the ground; others in beds. Some even sleep sitting in chairs. Of particular importance to the present invention however, are those human beings who sleep on their sides, in fetal position or in a face downward position.

For many of these side or face down sleepers, conventional pillows and head supports fail. The principal failures involve the inability of keeping the head and neck supported in a comfortable sleeping position without putting significant and undesirable pressure on various parts of the human face. For example, certain sideways or prostrate positions using conventional pillows will make the chin or jaw support the head and very often force the cheek and jaw into unnatural relative positions causing discomfort at the very least, and at the most, serious muscular or joint pain. Other problems include the blockage of airways into and through the nose and mouth, or a choking action on the throat. Conventional pillows also often put an unpleasant physical impact on a user's eyes. Allergic reactions are also common. Finally, many people have sensitive facial skin or are wearing an orthodontic device, both of which require as little direct facial contact and pressure as possible.

Many prior attempts have been made to resolve some of the problems resulting from the lack of comfort provided by conventional pillows. However, a great many of these have focused on creating pillow shapes that give better support and comfort to those persons who sleep on their backs. For example, Connell in U.S. Pat. No. 5,307,532 teaches a wedge-shaped pillow made from the composite of two interactive materials to provide a manipulative action to the head and neck. Similarly, Kjersem in U.S. Pat. No. 5,271,114 teaches a pillow folded over and fastened to itself to provide greater support for the nape of the neck of a user. Another unique pillow shape for back sleepers is taught by Summer in U.S. Pat. No. 4,768,246 and involves a flat round pillow having a generally hemispherical aperture to receive and support a user's head by distributing the weight of the head over a wide area. Yet another attempt is disclosed in Meyer et al., U.S. Pat. No. 5,088,141, which teaches a generally rectangularly shaped pillow with an irregularly-shaped central hollow. The purpose of this central hollow, as it was in related previous patents, is to receive and seat a user's head. Note however, Meyer et al. describe this head-receiving use for a person lying on his or her back as well as on either of his or her sides.

Another group of prior art patents is addressed to the solution of a similar though distinct problem; the support of a patient's head during a surgical operation particularly when the patient is lying in a face down or prone position. For example, Hartunian in U.S. Pat. No. 5,269,035 teaches the use of a substantially rectangular block of supporting material having a central opening from top to bottom, and at least one side opening. The block also has two top indentations which are used to support a patient's forehead and chin, respectively. Thus, a patient's head is supported such that the greater portion of his/her face is positioned in the central opening so that the patient's airways are unobstructed to allow for the passage of endotracheal or other tubes during surgery. The side opening also allows for the viewing of the patient's face during use. Ray et al. in U.S. Pat. No. 4,757,983 teach a similar face-down head support for surgery. This support also has central and side openings for the purposes described in Hartunian and further provides for pivotable adjustability for patient comfort.

Nevertheless, in spite of the attempts of the prior art, there remains a need for a pillow or a head support capable of holding a user's head in a comfortable stable position while the user is laying sideways or face downward without putting any undesirable contact pressure on various human facial elements. More particularly, a pillow is needed which, when in use, will not adversely impact a user's chin, jaw, cheek, nose, mouth or eye areas. It is toward the resolution of these goals that the present invention is directed.

BRIEF SUMMARY OF THE INVENTION

The present invention involves a unique and specially contoured pillow assembly which provides head and neck support for persons resting on their sides or in a face downward position. The most important structural features of this pillow are the unique upper lateral protrusions or nodes on either side of the pillow as well as other optional protrusions comprising the entire lateral contour of the pillow. In use, a resting person places a part of his/her forehead on one of the upper lateral protrusions while supporting the base of his/her head and his/her neck on the central or body portion of the pillow. When used as described, the weight bearing portions of the head are supported while the cheek, mouth, chin and jaw areas of the user are cantilevered from the pillow into a spaced pressure-free relationship above the supporting mattress disposed therebeneath.

Accordingly, it is a primary object of the present invention to provide a new and unique pillow structure that provides comfortable head and/or neck support to a person laying in sideways or face downward position while eliminating undesirable contact pressure on the user's chin, jaw, cheek, nose or mouth.

Another object of the present invention is to provide a new and unique pillow structure having upper lateral and/or other lower or medial protrusions for respectively supporting various portions of a user's head and face without adversely contacting and putting pressure on selected facial elements including, for example, the user's chin, jaw, mouth or cheek areas.

Still another object of the present invention is to provide a novel pillow assembly which enables the height of the pillow and/or its angle relative to its supporting surface to be readily adjusted to comply with the idiosyncratic desires of the user.

These and still further objects, as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF THE PREFERRED EMBODIMENT

Figure 1:
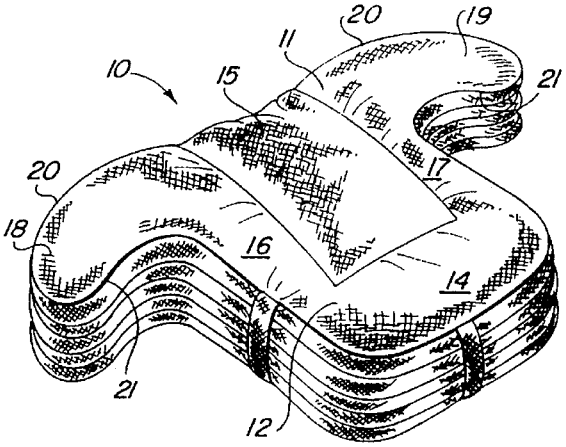
FIG. 1 is an isometric view of a pillow assembly embodying the present invention.

One embodiment of the pillow assembly of the present invention is shown in FIG. 1 and is identified by the general reference numeral 10. Pillow assembly 10 comprises an upper pillow 11 having a substantially rectangular central base portion 12 having a lower portion 14 and a sunken portion 15 situated adjacent to and above lower portion 14 and disposed between and framed by first and second side portions 16 and 17, respectively. Lower portion 14 and first and second side portions 16 and 17 generally have a greater thickness than that of sunken portion 15. Thus, sunken portion 15 provides the principal head support for persons laying on their backs. More specifically, sunken portion 15 is adapted to engage the contour of the back of a user's head while lower portion 14 props up and supports the user's neck when the user is on his/her back in face upward position.

Pillow 11 further comprises a first and a second lateral protrusion extending outwardly from side portions 16, 17 and designated here as first protrusion 18 and second protrusion 19, respectively. Protrusions 18, 19 are integrally formed with and extend outwardly from side portions 16, 17 as shown in FIG. 1. Protrusions 18, 19, may have any of a plurality of peripheral contours so long as each provides the forehead supporting function described hereafter in more detail. In the preferred embodiment, as shown in FIG. 1, each of protrusions 18, 19 has a specially shaped convex upper edge 20 and a concave lower edge 21, which, as will appear, provides greater contact-free support such as is described below.

Figure 2:
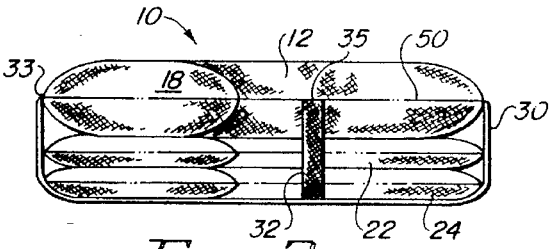
FIG. 2 is a side elevation of the pillow assembly of FIG. 1.
Figure 3:
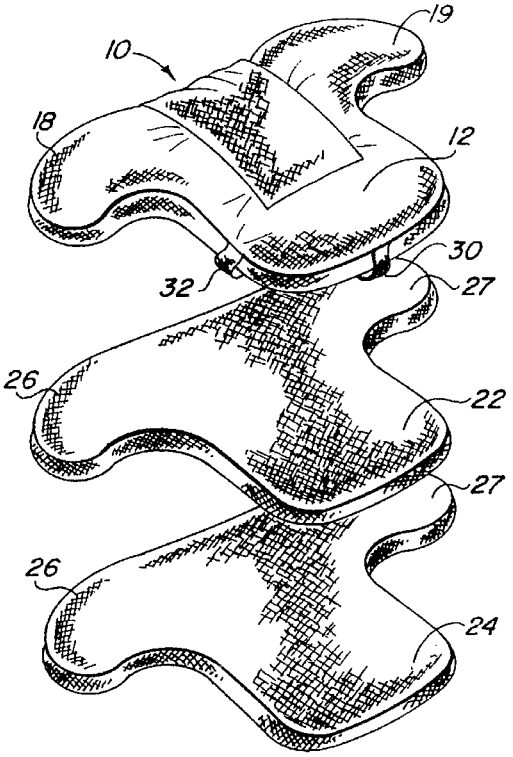
FIG. 3 is an exploded view of the pillow assembly of FIG. 1.
Figure 4:
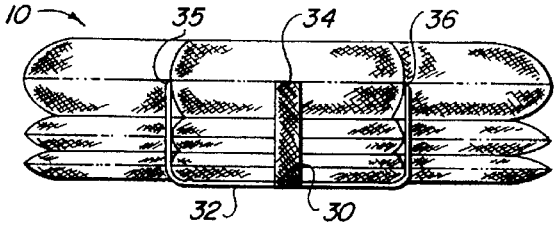
FIG. 4 is an end elevation of the pillow assembly of FIG. 1.

As shown in FIGS. 2, 3 and 4, pillow assembly 10 further comprises lift pads 22 and 24, each of which has an outer contour that, in plan, directly corresponds to the contour of pillow 11. The corresponding lateral protrusions of lift pads 22, 24 are identified in FIG. 3 as first lateral protrusion 26 and second lateral protrusion 27. Lift pads 22 and 24 are thinner than pillow 11 and are used to incrementally alter the height of pillow 11 above the plane of the normal user supporting surface such as a mattress, for example. Lift pads 22 and 24, as shown in FIGS. 2 and 4, are secured to the underside of pillow 11 by suitable fastening means such as by crossed elastic bands 30 and 32.

Elastic bands 30 and 32 are, as shown in FIGS. 2 and 4, attached to pillow 11 in crossing fashion. Thus, band 30 is attached at corresponding midpoints of the top and bottom edges 33, 34 of pillow 11 while band 32 is attached at the corresponding midpoints of first and second side edges 35, 36 of pillow 11. Bands 30, 32 are formed of a material which is sufficiently elastic to secure in place one or more lift pads as desired by the user for maximum comfort. FIG. 3 shows an exploded view of pillow assembly 10 including pillow 11 and lift pads 22 and 24 (with elastic bands 30, 32 only partially shown as they appear in their relaxed, unstretched position under pillow 11).

Figure 5:
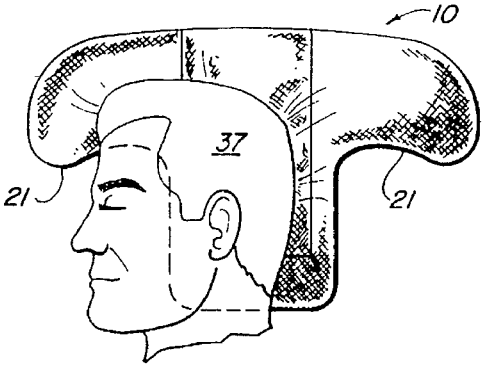
FIG. 5 is a plan view of the pillow assembly of FIG. 1 showing a user in phantom.

FIG. 5 shows a plan view of pillow assembly 10 as it is used for supporting a human head 37. Note how the user's eyes, nose, mouth, cheek and chin areas are cantilevered and free from contact by any part of pillow assembly 10.

Figure 6:
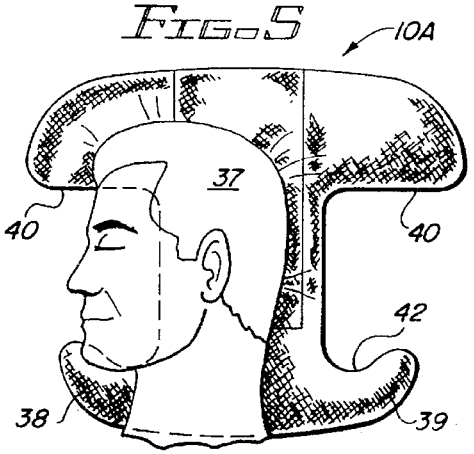
FIG. 6 is a plan view of an alternative embodiment of the present invention showing a user in phantom.

FIG. 6 shows an alternative embodiment 10A of the present invention in which lower lateral protrusions 38 and 39 extend outwardly from lower portion 14 to support a user's chin or lower jaw when such support is desired. Another variant in the embodiment of FIG. 6 comprises the flattening of the concave lower edges 21 as shown in FIGS. 1 and 5 to provide quasi-convex curvatures 40 on each lateral protrusion 18, 19. Additional concave curvatures 42 are shown on lower lateral protrusions 38, 39 for better lower facial conformance as desired.

Figure 7:
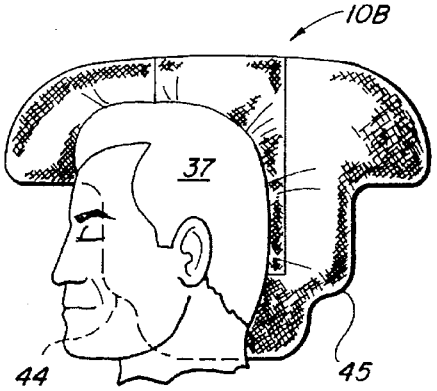
FIG. 7 is a plan view of yet another alternative embodiment of the present invention showing a user in phantom.

Still another alternative embodiment 10B is shown in FIG. 7 and comprises two medial lateral protrusions 44 and 45 which provide greater support to a user's facial cheek area when desired for special circumstances.

Pillow 11 is made using conventional pillow-making materials and techniques. Thus, a shell of conventional pillow casing materials are employed to encase a mass of conventional pillow filler (not shown) in a conventional manner. The filler may be natural down, artificial fiber, foam rubber or like material.

Pillow 11 is then enclosed by sewing or by using other standard techniques to form a seam which fastens top and bottom surfaces around the filler. Seam 50 circumscribes pillow 11 in normal fashion. In practice, it is preferred that the lateral protrusions included in a given embodiment be formed integrally with central base portion 12 in a master pattern. The same pattern is useful in creating lift pads 22, 24.

The fastening means comprising elastic bands 30 and 32 are simply attached by sewing each end of each band to pillow 11 at corresponding opposing side to side and upper to lower edge positions as described above and shown in FIGS. 1, 2 and 4. Bands 30 and 32 may be sewn into seam 50 at the proper locations during the actual construction of pillow 11.

In use, pillow 11 is placed on a user support surface such as the mattress of a bed (not shown) with upper lateral protrusions 18 and 19 aligned with and adjacent to the head of the bed. Lower part 14 is situated such that it is less remote from the user's center of gravity than are upper lateral protrusions 18 and 19. Thus, as the user lays down on his or her back, the user's neck will be supported by lower portion 14 while his or her head will be received and supported by central sunken portion 15.

When the user desires to rest on his or her side or stomach in face down position, the user's neck may continue to be supported by lower portion 14, while the central part of the user's head will rest on either side portion 16 or 17. The user's forehead will then be supported by either corresponding upper lateral protrusion 18 or 19. This positioning works equally well for resting on either side or in the face down position.

In an alternative embodiment shown in FIG. 6, additional support may be provided to the user by the addition of lower lateral protrusions 38 and 39 which, as shown, support the chin and jaw area when desired, while medial protrusions 44 and 45, as shown in FIG. 7, will provide additional support for the user's cheek area if desired. Again, any combination of these protrusions may be incorporated into any given embodiment of pillow 11 and remain within the intended scope of the present invention.

The main benefit to be derived from the provision of these additional protrusions 38, 39, 44, 45, is that they provide additional support for the user's head while he/she is laying in a sideways or face downward position without putting unnecessary or undue contact pressure on the more sensitive portions of the user's face. As is apparent, the different embodiments provide different areas of contact depending on which protrusions are chosen. For example, persons with sensitive jaws, chins or cheeks or those involved with orthodontia would prefer the embodiment of pillow 11 that is shown in FIG. 1. It is further noted that undue sensitivity may be a function of the weight supported on weak or damaged bones, or impaired muscles or other internal facial defects, and sensitivity may also be the result of skin or eye irritation caused by allergies or other adverse reactions. Still other user's may have particular breathing difficulties. These persons may then prefer an alternative embodiment such as those shown in either of FIG. 6 or 7.

Lastly, human beings are of various shapes and sizes, a fact which makes the embodiment involving one or more lift pads useful. Specifically, persons having longer necks or, who for other reasons desire higher pillows, can easily insert one or more lift pads 22, 24 to vary the height of pillow 11 above the surface of the user's bed.

From the foregoing, it is readily apparent that a new and useful embodiment of the present invention has been herein described and illustrated which fulfills all of the aforestated objects in a remarkably unexpected fashion. It is, of course, understood that such modifications, alterations and adaptations as may readily occur to the artisan confronted with this disclosure are intended within the spirit of this invention which is limited only by the scope of the claims appended hereto.

Accordingly, what is claimed is:

1. A pillow comprising a central base portion; two upper lateral protrusions integrally connected to said central base portion and extending outwardly therefrom; one or more lift pads; and means attached to said central base portion for securing said one or more lift pads on the underside thereof to vary the height of said central base portion and said two upper lateral protrusions, said means comprising first and second elastic straps attached to said central base portion so that said first elastic strap is disposed transversely relative to said second elastic strap across said underside of said central base portion.

2. A pillow comprising a central base portion; one or more lateral protrusions integrally connected to said central base portion and extending outwardly therefrom; and said pillow having means attached thereto for securing one or more lift pads on the underside thereof to vary the height of said central base portion and said one or more lateral protrusions, said means comprising first and second elastic straps attached to said central base portion so that said first elastic strap is disposed transversely relative to said second elastic strap across said underside of said pillow.

3. A pillow according to claim 2 in which said central base portion has a sunken support surface defined therein.

4. A pillow according to claim 2 in which said lateral protrusions are upper lateral protrusions.

5. A pillow according to claim 4 which further comprises lower lateral protrusions integrally connected to said central base portion.

6. A pillow according to claim 4 which further comprises medial lateral protrusions integrally connected to said central base portion and extending a shorter distance outwardly from said central base portion than said upper lateral protrusions.

7. A pillow having a top and a bottom surface, an upper and a lower edge, and first and second side edges and said pillow having means attached thereto for securing one or more lift pads adjacent said bottom surface to vary the height of said pillow; said means for attaching said lift pads comprising a first and a second elastic strap attached to said pillow, said first elastic strap extending between said upper edge and said lower edge, said second elastic strap extending between said first side edge and said second side edge across said bottom surface of said pillow in transverse relationship to said first elastic strap.

8. A pillow according to claim 7 in which said pillow has a sunken support surface defined therein.

9. A pillow according to claim 7 further having one or more lateral protrusions integrally attached thereto.

10. A pillow according to claim 9 in which said lateral protrusions are upper lateral protrusions.

11. A pillow according to claim 10 which further comprises lower lateral protrusions integrally connected to said central base portion.

12. A pillow according to claim 10 which further comprises medial lateral protrusions integrally connected to said central base portion and extending a shorter distance outwardly from said central base portion than said upper lateral protrusions.

* * * * *